US010617899B2

(12) United States Patent
Unrath

(10) Patent No.: US 10,617,899 B2
(45) Date of Patent: Apr. 14, 2020

(54) NOZZLE FOR WATER, IN PARTICULAR FOR A WATER CANNON

(71) Applicant: AWG Fittings GmbH, Ballendorf (DE)

(72) Inventor: Wilfried Unrath, Gerstetten (DE)

(73) Assignee: AWG Fittings GmbH, Ballendorf (DE)

( * ) Notice: Subject to any disclaimer, the term of this patent is extended or adjusted under 35 U.S.C. 154(b) by 0 days.

(21) Appl. No.: 15/658,823

(22) Filed: Jul. 25, 2017

(65) Prior Publication Data

US 2018/0021611 A1 Jan. 25, 2018

(30) Foreign Application Priority Data

Jul. 25, 2016 (DE) ..... 10 2016 213 551

(51) Int. Cl.
*B05B 1/00* (2006.01)
*A62C 31/02* (2006.01)
(Continued)

(52) U.S. Cl.
CPC ..... *A62C 31/02* (2013.01); *A62C 31/005* (2013.01); *A62C 31/03* (2013.01); *B05B 1/02* (2013.01); *A62C 3/08* (2013.01)

(58) Field of Classification Search
CPC ..... A62C 31/02; A62C 31/03; A62C 31/05; A62C 31/07; A62C 31/12; A62C 31/22; A62C 31/24; B05B 1/02; B05B 1/06
(Continued)

(56) References Cited

U.S. PATENT DOCUMENTS 198,356 A * 12/1877 Dailey ..... A61F 13/15682 19/145
210,941 A * 12/1878 Harrigan ..... B05B 1/3026 239/579
(Continued)

FOREIGN PATENT DOCUMENTS

AT 193182 B 11/1957
DE A0019987 M 9/1956
(Continued)

OTHER PUBLICATIONS

German Examination Report, dated May 24, 2017, for German Application No. 10 2016 213 551.1 (5 pages).
(Continued)

*Primary Examiner* — Viet Le
(74) *Attorney, Agent, or Firm* — Taylor IP, P.C.

(57) ABSTRACT

A full jet nozzle for use with a water cannon, the nozzle having a body that encloses a flow channel running along an axial direction, having an outlet opening provided at an axial end of the flow channel, which has an external circumference which encloses an outlet surface to form a flow cross-section. The flow cross-section has a substantially circular or annular base area. There is at least one radial cross-sectional extension of the outlet area is provided exclusively in an angular range of the outer circumference of a maximum of 180°. The full jet nozzle also has at least one radial cross-sectional extension formed by a slot running with its longitudinal axis parallel to the axial direction, which opens perpendicular to the base area or has a recess running with its longitudinal axis parallel to the axial direction, which opens perpendicular to the base area.

11 Claims, 3 Drawing Sheets

(51) Int. Cl.

| | |
|---|---|
| ***A62C 31/03*** | (2006.01) |
| ***A62C 31/00*** | (2006.01) |
| ***B05B 1/02*** | (2006.01) |
| *A62C 3/08* | (2006.01) |

(58) Field of Classification Search
USPC ... 239/299, 390, 443, 579, 601, 265.19, 590
See application file for complete search history.

(56) References Cited

U.S. PATENT DOCUMENTS 361,161 A * 4/1887 Jackson ..... B05B 1/14 239/590.3
458,762 A * 9/1891 Charonnat ..... B05B 3/06 239/73
521,763 A * 6/1894 Dreyfus ..... A01C 7/02 239/652
595,778 A * 12/1897 Knoop ..... B05B 1/262 239/390
1,082,713 A * 12/1913 Tolman ..... B05B 1/00 239/590
1,148,630 A * 8/1915 Schmidt ..... B05B 1/00 239/590
1,773,969 A * 8/1930 Whitehead ..... A46D 1/00 124/90
2,778,687 A * 1/1957 Hegstad ..... B05B 1/04 239/601
2,971,250 A * 2/1961 Wahlin ..... B05B 1/04 239/601
3,107,860 A * 10/1963 Umbricht ..... B05B 1/267 239/509
3,149,784 A * 9/1964 Skidgel ..... B05B 3/007 239/206
3,174,282 A * 3/1965 Harrison ..... F02K 1/36 181/215
3,266,737 A * 8/1966 Nees ..... B05B 1/04 239/504
3,415,426 A * 12/1968 Kleveland ..... B65D 83/14 222/402.11
3,737,108 A * 6/1973 Stumphauzer ..... B05B 1/04 239/598
3,756,106 A * 9/1973 Chadwick ..... B05B 1/10 239/601
3,877,865 A * 4/1975 Duperow ..... F24C 3/085 126/214 R
3,893,628 A * 7/1975 McCollum ..... B05B 1/185 239/521
4,460,130 A * 7/1984 Baumann ..... B05B 1/00 201/41
5,368,237 A * 11/1994 Fulkerson ..... B05B 1/02 239/526
5,664,733 A * 9/1997 Lott ..... B01F 5/02 239/429
5,775,446 A * 7/1998 Lott ..... E21B 10/18 175/424
5,782,414 A * 7/1998 Nathenson ..... E21B 7/18 239/532
5,785,258 A * 7/1998 Akin ..... B05B 1/02 175/424
5,833,148 A * 11/1998 Steinhilber ..... B05B 1/042 239/601
5,868,323 A * 2/1999 Cantor ..... B65D 47/0842 222/556
6,036,481 A * 3/2000 Legutko ..... F23D 14/08 239/552
6,752,685 B2 * 6/2004 Ulrich ..... B24C 1/045 451/102
7,325,753 B2 * 2/2008 Gregory ..... B05B 1/02 239/522
8,079,534 B2 * 12/2011 Fecht ..... B05B 1/042 239/590.5
8,177,148 B1 * 5/2012 Renquist ..... B05B 1/14 239/587.1
8,727,148 B2 * 5/2014 Soehnlen ..... B65D 47/0838 215/200
2002/0151250 A1 * 10/2002 Ulrich ..... B24C 1/045 451/2
2003/0057302 A1 * 3/2003 Swan ..... B05B 1/267 239/597
2004/0155125 A1 * 8/2004 Kramer ..... B05B 1/042 239/601
2004/0195402 A1 * 10/2004 Joshi ..... F23D 14/583 239/601
2005/0072866 A1 * 4/2005 Petit ..... B05B 1/34 239/590
2005/0127212 A1 * 6/2005 Kassanits ..... B05B 15/65 239/597
2009/0272826 A1 * 11/2009 Kioi ..... B05B 1/042 239/601

FOREIGN PATENT DOCUMENTS

| | | |
|---|---|---|
| DE | 10 2011 077 072 B3 | 10/2012 |
| DE | 10 2011 076 443 B4 | 1/2013 |
| JP | 2004 105312 A | 4/2004 |

OTHER PUBLICATIONS

European Search Report dated Nov. 8, 2017 for European Patent Application No. 17 18 1792 (7 pages).

* cited by examiner

NOZZLE FOR WATER, IN PARTICULAR FOR A WATER CANNON

BACKGROUND OF THE INVENTION

1. Field of the Invention

The invention relates to a water jet nozzle, in particular for a water cannon, particularly for use in a fire extinguishing apparatus

2. Description of the Related Art

Full jet nozzles for jet pipes are used at the end of fire-fighting hoses or for water cannons for fire extinguishing. Full jet nozzles for jet pipes are used at the end of fire-fighting hoses or for water cannons for fire extinguishing, have a single bore, which forms the outlet opening, wherein the bore usually forms a tapering at the end of the flow channel through the full jet nozzle. As in a ballistic throw, a certain throwing range can be produced with such a full jet nozzle. In practice, the water impact area is not a point or a circle but is always a round or oval impact area because the water which is sprayed out by the full jet nozzle flows apart in flight due to the air resistance and vortex formation and only propagates approximately along a cylindrical volume for the first few meters after the outlet opening.

The better and longer that the water jet emerging from the full jet nozzle remains focused, the greater is the throwing range and the smaller the impact area on the ground.

In addition to these full jet nozzles, there are hollow jet nozzles, also designated as ring jet nozzles, in which the flow cross-section of the outlet area is substantially annular. The hollow jet nozzle can be adjustable in order to focus the jet to a greater or lesser extent. With hollow jet nozzles a wider spray angle and an adjustability of the jet is produced. In the case of full jet nozzles on the other hand, the water is set in rotation before exiting in order to obtain a maximum spray angle of about 20°. Thus, in the fire-fighting area it is very important to distinguish between full jet nozzles and hollow jet nozzles. The hollow jet nozzles have a smaller throwing range than the full jet nozzles.

A disadvantage with the known water jet nozzles is that in particular as the water output of a water cannon, the throwing range is determined by the design of the nozzles and is fixed on a comparatively small water impact area, in particular on the ground. This means, for example, when fire-fighting at airports, in particular when cooling or extinguishing aircraft that the entire longitudinal area of an aircraft, for example, the aircraft fuselage simultaneously or at least a substantial part thereof, cannot be simultaneously cooled and/or extinguished. On the contrary, it has hitherto been necessary to vary the impact area along the aircraft fuselage by vertical movements of the nozzle, whereby the position of the impact of the water on the aircraft fuselage can be varied in practice but nevertheless the restriction to a simultaneous cooling of only a comparatively short section of the aircraft fuselage is possible.

Furthermore, with the known water jet nozzles it is not possible to form a fire protection wall in the manner of a water curtain. It is also not possible to apply water rapidly to a larger area on the ground.

DE 10 2011 077 072 B3 proposes a full jet nozzle having an outlet chamber and at least one outlet opening in an end face of the outlet chamber, wherein the outlet opening has a smaller cross-section than the outlet chamber and the end face is provided with at least three pocket-like recesses distributed over the circumference of the outlet opening in order to tear open the full jet emerging from the outlet opening and thereby provide a fine atomization which should better cool the seat of the fire than known full jets. As a result of the arrangement of the pocket-like recesses, a fine spray mist is generated around the full jet, which however as a result of its funnel-like distribution, can only produce a small cooling effect per unit area.

DE A0019987 M AZ discloses a liquid jet for foam jet pipes for fire extinguishing purposes for producing a hollow jet wherein cross-sectional widenings are provided uniformly distributed over the circumference of the flow cross-section.

AT 193182 B discloses a nozzle for sprinklers or watering appliances in which a main flow is guided almost undisturbed through the nozzle of the sprinkler and an auxiliary flow is further produced by a gap in the nozzle wall which flows towards an impact or deflecting surface in order to achieve a sprinkling in the vicinity of the sprinkler. The impact or deflecting surface is thereby formed in the gap in the nozzle wall whereby the gap is slot-shaped with a slot angled at an acute angle obliquely to the axis of the nozzle orifice.

DE 10 2011 076 443 B4 discloses a non-return valve for a spray nozzle and a nozzle pipe.

An efficient delivery of flow from a water jet nozzle is needed.

SUMMARY OF THE INVENTION

The present invention is based on the object of providing a water jet nozzle which is particularly suitable for a water cannon (monitor) and which with unchanged high throwing range, at the same time allows the cooling of particularly long objects, the production of a fire protection wall and improved cooling of large areas.

The present invention relates to full jet nozzles which accordingly have a flow cross-section which has an at least substantially circular surface area.

The object according to the invention is solved by a full jet nozzle having the features of the claims. Advantageous and particularly expedient configurations of the invention are specified in the dependent claims.

The full jet nozzle, according to the present invention, in particular for a water cannon (or monitor), includes an outlet opening which has an external circumference which encloses an outlet surface to form a flow cross-section. The flow cross-section has an at least substantially circular base area. The base area is in particular that at least substantially circular flow cross-section which forms the largest part of the outlet opening.

According to the present invention, at least one radial cross-sectional extension of the outlet area is provided exclusively in an angular range of the outer circumference, wherein the angular range is a maximum of 180°.

Accordingly, the present invention provides at least a single cross-sectional extension on the external circumference of the outlet opening, or a plurality of cross-sectional extensions are provided on the external circumference of the outlet opening, which then however are not arranged or distributed over the entire external circumference of the outlet opening but there remains a region of at least 180°, that is of at least half the external circumference, in which no radial cross-sectional extension is provided. That is, in this region the external circumference exclusively follows a circular shape.

When as in the present case of a full jet nozzle, there is a discussion of a flow cross-section having a circular base area, this means a fully circular base area, i.e. the base area of a full circle.

The full jet nozzle according to the invention has a flow channel running along an axial direction or encloses this, wherein the outlet opening is provided at the outlet end of the flow channel. The at least one radial cross-sectional extension that is formed by a slot running with its longitudinal axis parallel to the axial direction of the flow channel, which opens perpendicular to the base area, or a recess running with its longitudinal axis parallel to the axial direction of the flow channel, which opens perpendicular to the base area. In this case, the slot, or the recess, in particular, runs exclusively along the axial direction of the flow channel, accordingly no inclination, for example, to provide an impact surface is provided. On the contrary, the slot, or the recess, merely enables a corresponding expansion of the jet flowing through the flow channel without deflecting this laterally in the axial direction.

If a slot is provided according to the present invention, this extends as far as to the radially external circumference of the full jet nozzle—that is the slot is configured to be open at the edge outwards in the radial direction. If on the other hand, a recess is provided, the radial cross-sectional extension does not extend as far as to the outer surface of the nozzle, but the outlet opening and the recess are enclosed by an external circumference, i.e. a wall or an edge, over the full circumference.

Particularly advantageously the angular range of the external circumference of the outlet opening in which the at least one radial cross-sectional extension is provided extends over a maximum of 90°, and in particular over a maximum of 60° or 45° or 30°.

In the present case, radial cross-sectional extension means any local protuberance of the outlet surface starting from the base area radially outwards, notwithstanding the shape of the protuberance. This can be rounded, substantially rounded or even pointed or can also have bent or angled shapes.

The angular range of the external circumference of the outlet opening is provided with the at least one radial cross-sectional extension in a usage of the full jet nozzle as intended, at least temporarily along a lower half of the external circumference of the outlet opening so that advantageously a tearing open of the full jet starting from the cylindrical shape only takes place downwards in relation to the trajectory of the jet. Thus, a concentrated cooling of the area underneath the jet can take place, in particular, starting from a few meters after the water exits from the nozzle as far as the impact area of the jet on the ground or the fire object.

According to one embodiment of the invention, the full jet nozzle includes a multipart nozzle body having an axial end section in which the outlet opening is provided and which can be turned with respect to an adjoining axial section, in order to turn the angular range of the external circumference, with the at least one radial cross-sectional extension, about an axis of rotation, perpendicular to the outlet surface, in particular by at least 180°. The adjoining axial section in particular immediately adjoins the end section.

It is favorable if the at least one radial cross-sectional extension forms a flow cross-section, which is a maximum of 25% of the base area of the flow cross-section of the full jet, in particular is a maximum of 20% or even a maximum of 10%. As a result, any impairment of the throwing range of the full jet can be avoided. In the case of several radial cross-sectional extensions, in particular the total flow cross-section is a maximum of 10% of the base area.

According to one embodiment of the invention, the at least one radial cross-sectional extension is at least substantially triangular, that is it has a flow cross-section that can be described by means of a triangle. One side of the triangle naturally follows the external circumference of the base area, and accordingly substantially a circular path.

According to one embodiment of the invention, the at least one radial cross-sectional extension is at least substantially trapezoidal, that is it has a flow cross-section, which can be described by means of a trapezium. The base of the trapezium naturally follows the external circumference of the base area, accordingly substantially a circular path. Here base means that the side line of the trapezium enclosing the cross-section, which is positioned radially inside the jet nozzle, i.e. an imaginary line which separates the circular base area from the radial cross-sectional extension, i.e. the trapezium area. The outer side of the trapezium can be straight or also bent, in particular in the form of a circular path.

It is favorable if the full jet nozzle has a flow channel extending in the axial direction, which opens directly in the outlet opening, and a last axial section of the flow channel, in the flow direction, is reduced in diameter compared with a directly adjoining axial section of the flow channel, located upstream. By this means the flow velocity of the water or water jet emerging from the outlet opening can be increased.

It is favorable if the at least one radial cross-sectional extension is provided exclusively in the last axial section of the flow channel, that is, the adjoining axial section upstream is free from such a radial cross-sectional extension and in particular is rotationally symmetrical, or is enclosed by a circular, or substantially circular, circumference.

In order to reduce turbulence in the flow, and thereby increase the throwing range of the nozzle, a jet guiding profile can be provided in the axial section of the flow channel located upstream, which divides the flow cross-section into individual circular sectors, wherein the jet guiding profile extends, in the manner of a guide vane, in the axial direction.

The jet nozzle according to the invention can be manufactured, by introducing, in particular by milling, a radial cross-sectional extension into the outlet opening on a full jet nozzle having a fully circular flow cross-section of the outlet opening. Thus, existing jet nozzles can easily be retrofitted according to the invention.

A sprinkling of the full jet, over the entire length of the throwing range, can advantageously be achieved by the invention. Thus, not only a single far-removed impact area, but a very long and narrow impact area on the ground, is achieved, beginning a few meters after the nozzle and ending with the maximum throwing range. For example, the following values can be made available, or provided, by the jet nozzle according to the invention: 5,000 l of water throughput per minute, 8 bar water pressure at the inlet of the jet nozzle, a throwing range along the jet nozzle in the range of 8 to 60 meters.

The nozzle can for example be screwed onto a jet pipe via a thread and then, by appropriate twisting, brought into a position in which the at least one radial cross-sectional extension lies, at least partially, below the base area of the flow cross-section, in particular, perpendicularly below the lowest point of the base area. According to one embodiment of the present invention, the nozzle or the outlet opening is fixed in this position on the jet pipe. Another embodiment provides an optional twistability in order to switch on and off the sprinkling effect.

Switching off can be accomplished, whereby the radial cross-sectional extension can be twisted between an effective, and an ineffective position. In the effective position, the flow cross-section of the radial extension is free for the passage of water. In the ineffective position, the flow cross-section is concealed so that none, or substantially no water, can pass through and therefore only the base area of the outlet opening is available as an exit for the water jet. The effective position is, in particular, provided below, for example, perpendicularly below the lowest point of the base area. The radial cross-sectional extension could also be held in a fixed position and could instead be covered, as desired, by a twistable or displaceable screen, in order to switch on and off the sprinkling effect. It is also possible that the flow cross-section of the radial extension is always open, but for switching off the sprinkling effect. The radial cross-sectional extension can be twisted into a position above the base area of the flow cross-section of the nozzle, and is therefore ineffective, because the full jet emerging from the base area simply carries away the water emerging from the cross-sectional extension when this, so to speak, sprinkles onto the full jet.

If the nozzle according to the invention for application of water has a larger area on the ground, or is used from above on burning material, the nozzle must only be aligned at a suitable angle of attack with respect to the horizontal, for example from 25° to 30° and pivoted horizontally, whereas with conventional jet nozzles, both a horizontal and vertical pivoting would be necessary, the latter in order to vary the throwing range.

If the nozzle is pivoted over 360°, a complete round area can be covered in the form of a full circle.

If an angle of attack with respect to a horizontal plane of close to 90° is selected with the nozzle according to the present invention, this results in a radius around the exit point of the water, to which water is applied, for example, around a vehicle with a mounted water cannon. This can be life-saving in the case of vegetation fires.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
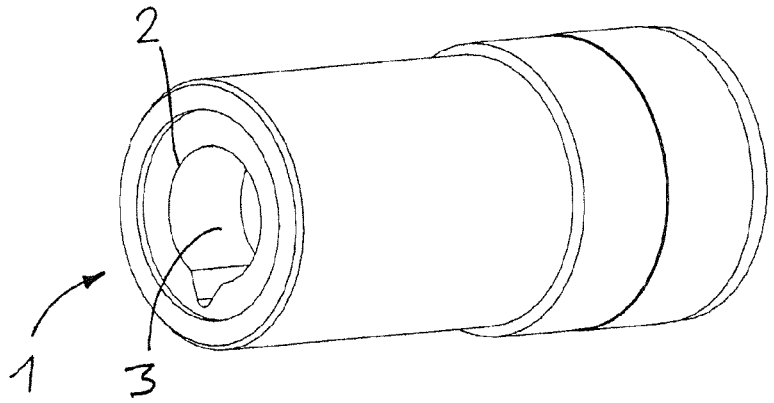
FIG. 1 is a perspective view of an exemplary design of a full jet nozzle according to an embodiment of the present invention.

Referring to FIG. 1, there is shown a full jet nozzle executed according to the invention, which for example, can be mounted on an extinguishing arm, or at the end of a jet pipe, of an extinguishing vehicle or airfield extinguishing vehicle. The nozzle has an outlet opening 1 for the water jet. The outlet opening 1 is provided in the region of the axial end of the nozzle opposite to a second axial end via which water enters into the nozzle.

Figure 2:
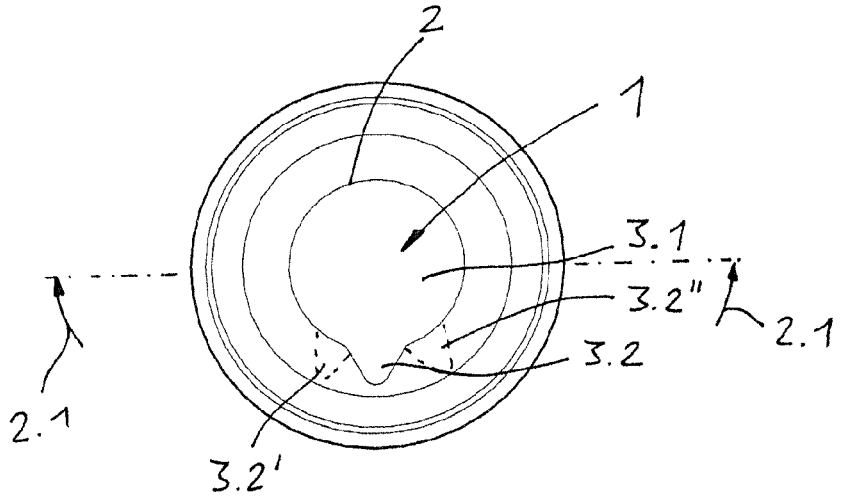
FIG. 2 is a plan view of the exit opening of the full jet nozzle of FIG. 1.

As can be seen from FIGS. 1 and 2, the outlet opening 1 has an external circumference 2, which encloses the outlet area to form a flow cross-section 3 for the water. The flow cross-section 3 here has an at least substantially circular base area 3.1 and a radial cross-sectional extension 3.2. The total flow cross-section in the outlet opening 1 for the water includes the base area 3.1, and the radial cross-sectional extension 3.2, which could also be designated as keyhole-shaped.

However, the invention is not restricted to a single radial cross-sectional extension 3.2. On the contrary, several radial cross-sectional extensions could be provided, wherein a second radial cross-sectional extension 3.2' and a third radial cross-sectional extension 3.2" are indicated schematically in FIG. 2 by dashed lines. The crucial thing however is that all the radial cross-sectional extensions 3.2, and optionally 3.2', 3.2", are only connected to the base area 3.1 in a predefined angular range 2.1 of the external circumference 2, wherein the angular range 2.1 is a maximum of 180°.

Preferably the angular range 2.1, as shown in FIG. 2, extends exclusively along an underside or lower half of the outlet opening 1.

Figure 3:
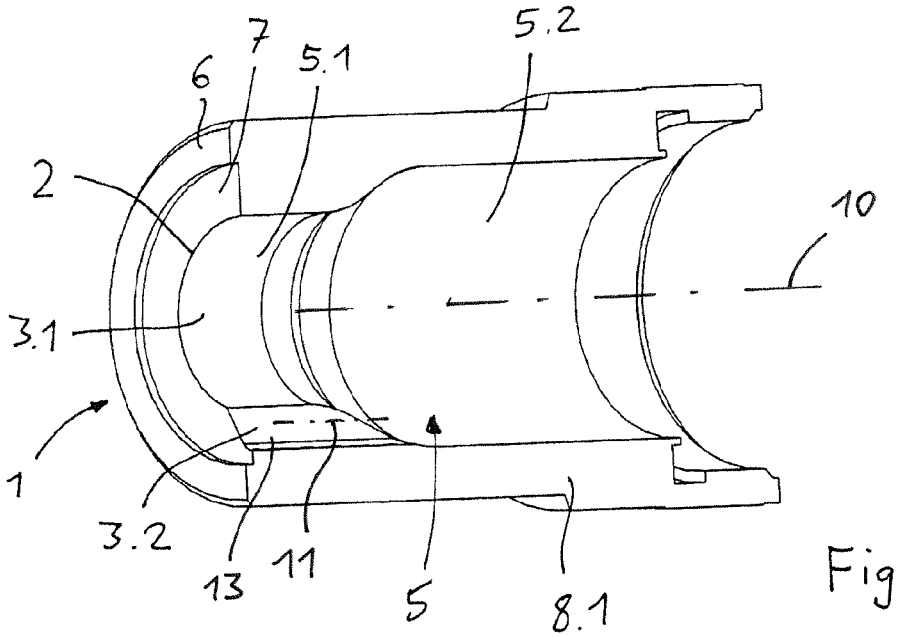
FIG. 3 is a longitudinal section cut away view through the full jet nozzle of FIG. 1.

In the sectional view in FIG. 3, it is further shown that the full jet nozzle has a flow channel 5 extending in the axial direction 10, which opens in the outlet opening 1. A last axial section 5.1 of the flow channel 5 in the flow direction of the water through the full jet nozzle is reduced in diameter compared with a directly adjoining axial section 5.2 of the flow channel located upstream. An acceleration of the water before the exit from the outlet opening 1 and therefore a larger throwing range of the water jet is thereby achieved. The longitudinal axis 11 of the cross-sectional extension 3.2, here in the form of a recess 13, runs parallel to the axial direction 10.

As can also be clearly seen from FIG. 3, the nozzle has a web 6 at the water-outlet-side end which protrudes somewhat in the axial direction with respect to an end face 7 in which the outlet opening 1 is provided and encloses the outlet opening 1.

Whereas only one axial end section 8.1 of the nozzle body is shown in FIGS. 1-3, FIG. 4 furthermore shows an adjoining axial section 8.2 of the nozzle body, with respect to which the axial end section 8.1 can be twisted, in order to vary the position of the at least one radial cross-sectional extension 3.2, over the external circumference 2 of the outlet opening 1. The at least one radial cross-sectional extension 3.2 can be brought from its downwardly aligned position, into a laterally, or upwardly, aligned position in a stepped, or stepless, manner.

Figure 4:
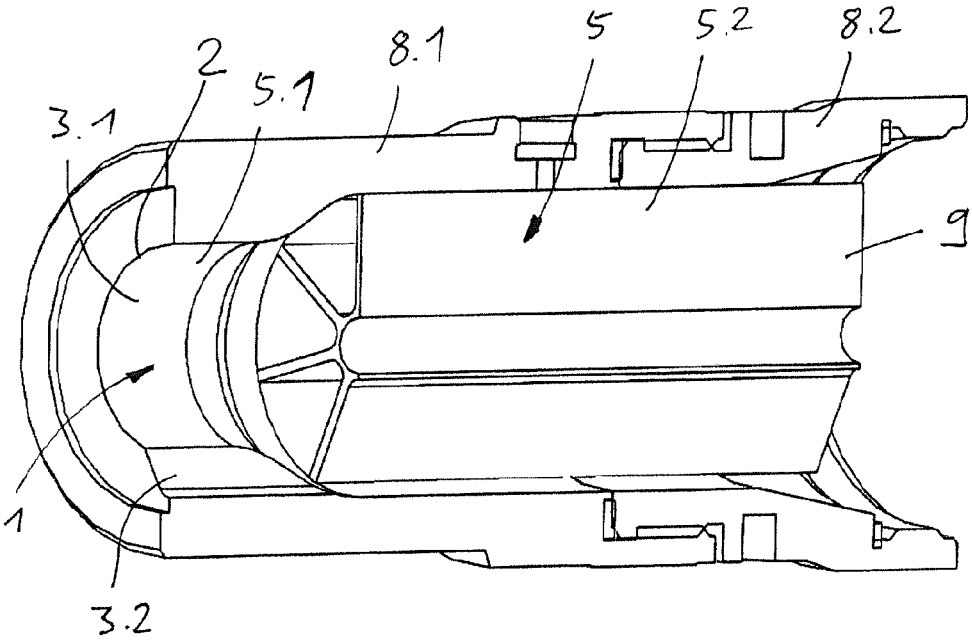
FIG. 4 illustrates an embodiment of the present invention with a jet guiding profile.

Furthermore, it is shown as an example in FIG. 4 that a jet guiding profile 9 can be provided in the flow channel 5, in particular upstream axial section 5.2, having comparatively larger diameter, in order to reduce turbulences in the flow.

The jet guiding profile 9 divides the flow channel 5 into individual circular sectors. In an exemplary embodiment, the jet guiding profile 9 further divides the flow channel 5 into a core bore, which is enclosed by circular sectors.

Figure 5:
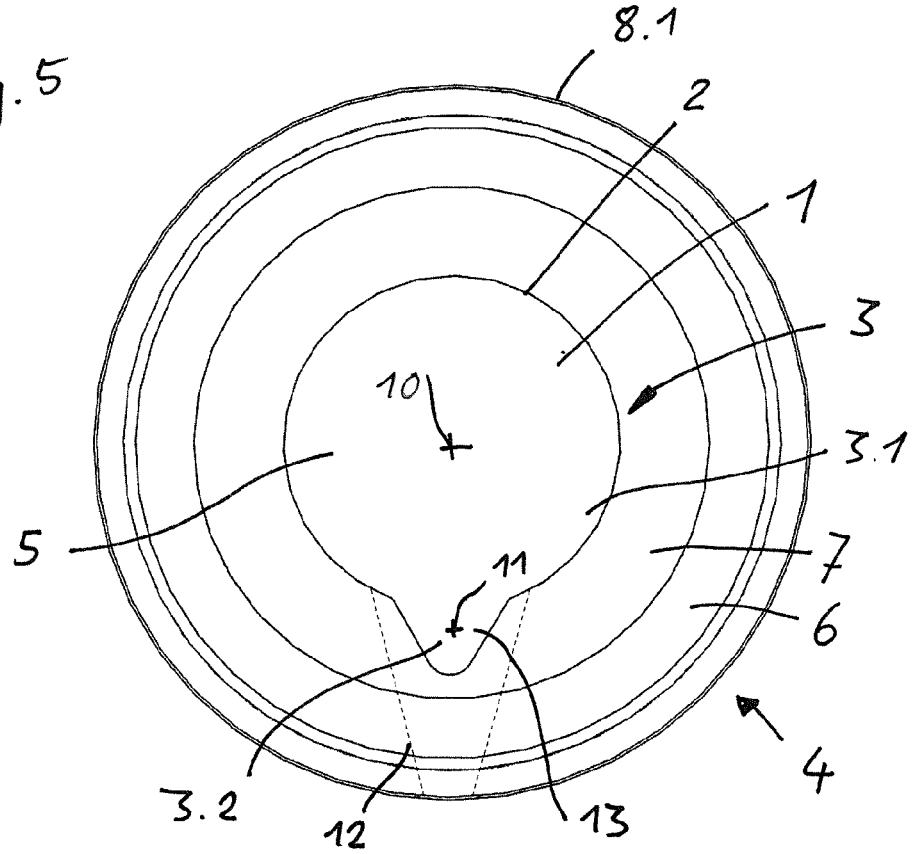
FIG. 5 is a plan view of the exit opening of a full jet nozzle executed according to the invention.

In the exemplary embodiment of a full jet nozzle, according to the invention, shown in FIG. 5, it can again be clearly seen that the radial cross-sectional extension 3.2, which adjoins the annular base area 3.1, of the flow cross-section 3, in order to form the outlet opening 1 of the flow channel 5, is provided in the lower half 4 of the full jet nozzle. Here, also according to a particularly preferred embodiment, a single cross-sectional extension 3.2 is provided, which is connected centrally, at the bottom of the annular base area 3.1.

The cross-sectional extension 3.2 is formed by a recess 13, whose longitudinal axis 11 runs parallel to the axial direction 10 of the flow channel 5. The recess 13 does not extend as far as the radially outer surface of the nozzle, or the nozzle body, here of the axial end section 8.1. However, the dashed line indicates that the cross-sectional extension 3.2 could also be guided as far as the radially outer surface of the nozzle, or the end section 8.1, then in the form of a slot 12. Advantageously the slot 12 tapers radially from inside to outside so that it approximately has the cross-section or a triangle, or at least approximately the cross-section of a trapezium.

Figure 6:
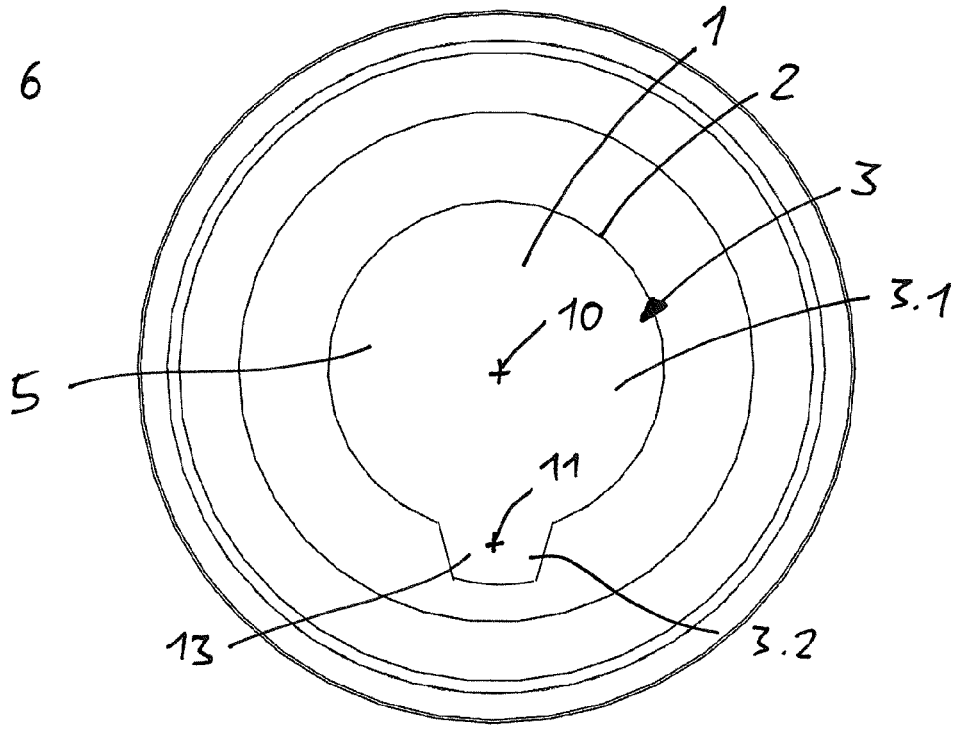
FIG. 6 is a plan view of the exit opening of a hollow jet nozzle executed according to another embodiment of the present invention with a trapezoidal cross-sectional extension.

FIG. 6 shows how a cross-sectional extension 3.2 in the form of a recess 13 having a trapezoidal cross-section could appear. Here also the flow cross-section of the cross-sectional extension 3.2 tapers, in particular radially, from inside to outside.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF REFERENCE NUMERALS

1 Outlet opening
2 Circumference
2.1 Angular range
3 Flow cross-section
3.1 Base area
3.2 Cross-sectional extension
4 Lower half
5 Flow channel
5.1 Last axial section
5.2 Upstream axial section
6 Web
7 End face
8.1 Axial end section
8.2 Axial section
9 Jet guiding profile
10 Axial direction
11 Longitudinal axis
12 Slot
13 Recess

What is claimed is:

1. In a water cannon, a full jet nozzle, comprising:

a body having a flow channel running along an axial direction having an outlet opening provided at an axial end of the flow channel which has an external circumference which encloses an outlet surface to form a flow cross-section and an inlet opening provided at an end opposite to the axial end of the flow channel, the inlet opening configured to receive and operate at a water pressure sufficient for use as a water cannon, the flow cross-section having an at least substantially circular base area, the flow channel has an upstream axial section and a downstream axial section that includes the outlet opening;

at least one radial cross-sectional extension of the outlet opening is provided exclusively in an angular range of the external circumference, the angular range being a maximum of 180°, and the angular range extends along a lower half of the external circumference; and wherein the at least one radial cross-sectional extension includes a slot running with a longitudinal axis parallel to the axial direction of the flow channel, which opens perpendicular to the base area or a recess running with its longitudinal axis parallel to the axial direction of the flow channel, which opens perpendicular to the base area, the slot or the recess only extends along the downstream axial section, wherein the flow cross-section and the at least one radial cross-sectional extension together are configured for providing a jet of the water cannon with a throwing range and a cooling of an area underneath the jet.

2. The full jet nozzle of claim 1, wherein the angular range is a maximum of 90°.

3. The full jet nozzle of claim 1, wherein a single radial cross-sectional extension is provided in the angular range.

4. The full jet nozzle of claim 1, further comprising a multipart nozzle body having parts which are adjustable relative to one another in order to bring into a position above the base area an axial end section in which the outlet opening is provided, wherein the multipart nozzle body includes an adjoining axial section which can be turned in order to adjust through the angular range of the external circumference with the at least one radial cross-sectional extension about an axis of rotation perpendicular to the outlet surface.

5. The full jet nozzle claim 1, wherein the at least one radial cross-sectional extension forms a flow cross-section which is a maximum of 25% of the base area.

6. The full jet nozzle claim 5, wherein the at least one radial cross-sectional extension forms a flow cross-section which is a maximum of 20% of the base area.

7. The full jet nozzle claim 6, wherein the at least one radial cross-sectional extension forms a flow cross-section which is a maximum of 10% of the base area.

8. The full jet nozzle of claim 1, wherein the radial cross-sectional extension is substantially triangular.

9. The full jet nozzle of claim 1, wherein at least one of a last axial section of the flow channel in a flow direction is mirror-symmetrical along a vertical plane running through a central axis of the flow channel and the full jet nozzle or at least the flow-guiding parts of the same is/are mirror-symmetrical to the vertical plane.

10. The full jet nozzle of claim 1, wherein the water pressure is approximately 8 bar.

11. The full jet nozzle of claim 1, wherein the upstream axial section includes a first length and a first diameter and the downstream axial section includes a second length which is less than the first length and a second diameter which is less than the first diameter, and the slot or the recess extends along the second length of the downstream axial section of the flow channel.

* * * * *